United States Patent [19]

Inui et al.

[11] Patent Number: 4,639,208

[45] Date of Patent: Jan. 27, 1987

[54] PULSE COMBUSTION APPARATUS WITH A PLURALITY OF PULSE BURNERS

[75] Inventors: Isao Inui; Masato Hosaka, both of Osaka; Mitsuyoshi Nakamoto; Kenji Okamoto, both of Nara, all of Japan

[73] Assignee: Matsushita Electric Industrial Co., Ltd., Japan

[21] Appl. No.: 718,452

[22] Filed: Apr. 1, 1985

[30] Foreign Application Priority Data

| | | | |
|---|---|---|---|
| Apr. 3, 1984 | [JP] | Japan | 59-66073 |
| Apr. 3, 1984 | [JP] | Japan | 59-66074 |
| Apr. 3, 1984 | [JP] | Japan | 59-66075 |
| Apr. 3, 1984 | [JP] | Japan | 59-66076 |
| Apr. 9, 1984 | [JP] | Japan | 59-70284 |
| Aug. 18, 1984 | [JP] | Japan | 59-171919 |

[51] Int. Cl.[4] ..... F23C 11/04

[52] U.S. Cl. ..... 431/1

[58] Field of Search ..... 122/24; 431/1

[56] References Cited

U.S. PATENT DOCUMENTS

| | | | |
|---|---|---|---|
| 3,119,436 | 1/1964 | Rydberg | 431/1 |
| 3,606,867 | 9/1971 | Briffa | 431/1 |
| 3,738,290 | 6/1973 | Belter | 431/1 |
| 4,314,444 | 2/1982 | Putnan et al. | 122/24 |

FOREIGN PATENT DOCUMENTS

| | | | |
|---|---|---|---|
| 270783 | 12/1950 | Switzerland | 431/1 |
| 1173083 | 12/1969 | United Kingdom | 431/1 |

*Primary Examiner*—Carroll B. Dority, Jr.

*Attorney, Agent, or Firm*—Lowe, Price, LeBlanc, Becker & Shur

[57] ABSTRACT

In a pulse combustion apparatus, a plurality of identical pulse burners are employed such that a total amount of fuel to be burned is divided into equal amounts which are assigned to respective pulse burners. Either cushion chambers or tail pipes of the pulse burners are arranged to communicate with each other via one or more communicating passages so that interaction occurs in connection with pressure in the exhaust systems of the plurality of pulse burners. The interaction between combustion chambers causes the timings of combustion in the plurality of pulse burners to be synchronized, thus suppressing the occurrence of uncomfortable beat. In some embodiments, a sound-insulating mechanism is employed in each cushion chamber so that propagation of combustion sound to downstream side is effectively suppressed while the heat exchanging coefficient is simultaneously increased. In a further embodiment, sound-absorption materials are used in air pipes and air chambers of each pulse burner for effectively preventing propagation of combustion sound to upstream side.

24 Claims, 16 Drawing Figures

PULSE COMBUSTION APPARATUS WITH A PLURALITY OF PULSE BURNERS

BACKGROUND OF THE INVENTION

This invention relates generally to pulse combustion apparatus used as a heat source of hot-water supply apparatus, hot air type heaters or the like, using pulse combustion system having features that combustion takes place with forced intake air and exhaust gasses without a blower while heat conductivity is high.

Generally speaking, the utilization coefficient of thermal energy obtained by combustion in hot-water supply apparatus, hot air type heater or the like is up to 85% at the best, and the improvement of the utilization coefficient to save energy is highly desired.

Conventionally, as measures for improving utilization coefficient various techniques, such as the provision of an auxiliary heat exchanger for recovering heat from exhaust gases, or the utilization of a blower having a large capacity for causing turbulent combustion, have been considered. However, these conventional techniques require a large-capacity auxiliary heat exchanger or result in the occurrence of noise due to the presence of the blower and the turbulent combustion.

Another approach for resolving the above problem is an application of a pulse combination system which was investigated around the time of the oil crisis of 1973, and some apparatus using such pulse combustion is in practical use. However, pulse combustion is based on explosion, and therefore its operating noise level is inherently high. For this reason, it has been desired to decrease the noise level of pulse combustion apparatus although some is already in practical use.

SUMMARY OF THE INVENTION

The present invention has been developed in order to remove the above-described drawbacks inherent to the conventional pulse combustion apparatus.

It is, therefore, an object of the present invention to provide a new and useful pulse combustion apparatus operable at a low noise level.

According to a feature of the present invention, a given amount of fuel to be burned is divided into a plurality of equal amounts so that a plurality of burners are used for combustion of the fuel, while sound insulating and sound absorbing functions are added to reduce the overall noise level by reducing the amount of combustion noise propagated and emitted outside.

However, when a plurality of pulse burners are used simultaneously such that these burners are arranged nearby for combustion, beat is apt to occur due to the difference in combustion frequency. According to the present invention, however, the occurrence of beat is suppressed by employing a structure which establishes communication between exhaust passages of the plurality of pulse burners. As such communication is established, pressure variation in either the cushion chamber or tail pipe of each pulse burner affects the pressure of other pulse burner(s), causing synchronization of combustion in the combustion chambers of respective pulse burners. When synchronized combustion is established, no beat occurs since the frequency of combustion is identical. As a result, noise reduction using a plurality of pulse burners is effectively achieved. In some embodiments, sound-insulating mechanism is employed in each cushion chamber so that propagation of combustion sound to the downstream side is effectively suppressed while heat exchanging coefficient is simultaneously increased. In a further embodiment, sound-absorption materials are used in air pipes and air chambers of each pulse burner for effectively preventing propagation of combustion sound to the upstream side.

In accordance with the present invntion there is provided a pulse combustion apparatus, comprising: a fuel supply means; air supply means; a plurality of pulse burners coupled with the fuel supply means and the air supply means; each of the pulse burners having a combustion chamber, and an exhaust passage including a tail pipe communicating, at one end thereof, with the combustion chamber, and a cushion chamber communicating with the tail pipe at the other end of the tail pipe; and means for establishing communication between the exhaust passages of the plurality of pulse burners.

BRIEF DESCRIPTION OF THE DRAWINGS

The object and features of the present invention will become more readily apparent from the following detailed description of the preferred embodiments taken in conjunction with the accompanying drawings, in which:

FIG. 12 is a schematic partially cross-sectional front view of another embodiment of the pulse combustion apparatus according to the present invention, wherein sound absorbing means is built in;

The same or corresponding elements and parts are designated by like reference numerals thoughout the drawings.

DETAILED DESCRIPTION OF THE INVENTION

Figure 1:
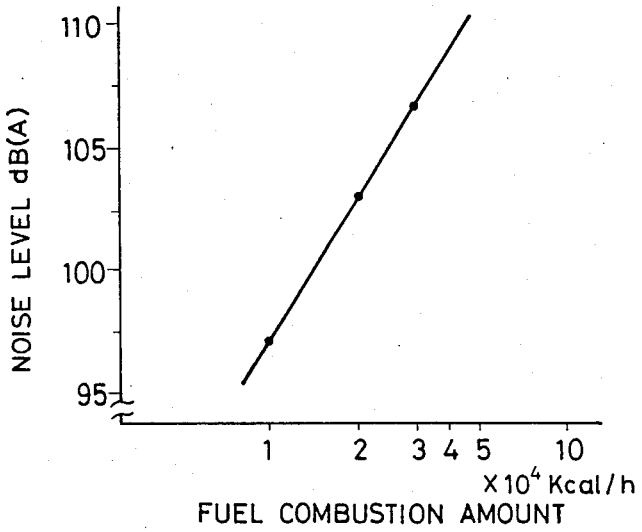
FIG. 1 is a graph showing the relationship between the amount of fuel combustion and noise level of a pulse burner.

Prior to describing the preferred embodiments of the present invention, the reason why the noise level of the sound source can be reduced when the amount of fuel combustion is divided into a plurality of amounts is worth considering. FIG. 1 shows the relationship between the amount of fuel combustion by a pulse burner and the combustion sound or noise therefrom, which relationship is obtained through experiments carried out with the same combustion chamber load. More specifically, the noise level at an arbitrary amount of fuel combustion is given by the following Eq. (1).

$$N=No+20 \log Q/Qo \text{ [dB } (A)] \quad (1)$$

wherein

N is noise level when the amount of fuel combustion is Q kcal/h;

No is noise level in sound pressure level when the amount of fuel combustion is Qo kcal/h.

Assuming that an amount $Q=nQo$ [kcal/h] of fuel is combusted by a single burner, a resulting noise level can be given by the following Eq. (2) in accordance with Eq. (1):

$$N=No+20 \log n \text{ [dB } (A)] \quad (2)$$

On the other hand, when n burners each having an amount of fuel combustion of Qo kcal/h are used simultaneously with the combustion chamber load being unchanged from that of the single burner, a resultant noise level Nn is given by the following Eq. (3):

$$Nn=No+10 \log n \text{ [dB } (A)] \quad (3)$$

Figure 2:
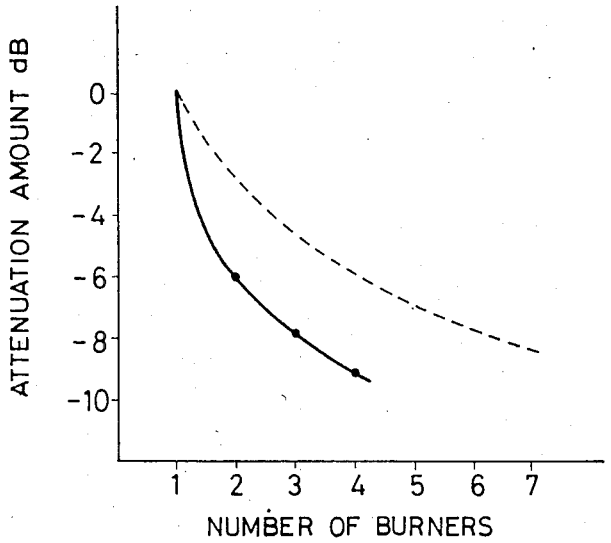
FIG. 2 is a graph showing the relationship between the attenuation amount of noise level and the number of burners used with the division of total amount of fuel into equal amounts.

From the comparison between Eqs. (2) and (3), it will be understood that the noise level can be reduced by 10 log n dB when fuel is divided into n to be combusted by n burners under conditions of the same combustion chamber load. This reduction in noise level is best seen in FIG. 2 as a dotted curve. Although the greater the number of pulse burners the lower the noise level, the number of pulse burners may be two to four for practical use.

When two or more pulse burners are used to be juxtaposed, uncomfortable beat is apt to occur due to slight frequency difference between pulse combustions of the respective pulse burners. According to the present invention, the acting pressures in respective pulse burners are made to undergo interaction or interference by arranging cushion chambers in communication with each other or tail pipes communicating with each other. The occurrence of beat can be suppressed by such interaction, and therefore, a reduction in noise level by the division of combustion fuel amount can be achieved. In addition, sound insulating mechanism may be provided within the cushion chambers so as to reduce the sound propagating to downstream side, while sound absorbing mechanism within air chambers and air pipes located upstream of the combustion chamber reduces the sound propagating to the upstream side. In the above, the sound insulating mechanism provided within the cushion chambers has an advantage of increasing the heat exchange coefficient since it operates to cause high-temperature combustion gas flow to be in contact with the heat exchanging surfaces and to flow at a high-speed.

Figure 3:
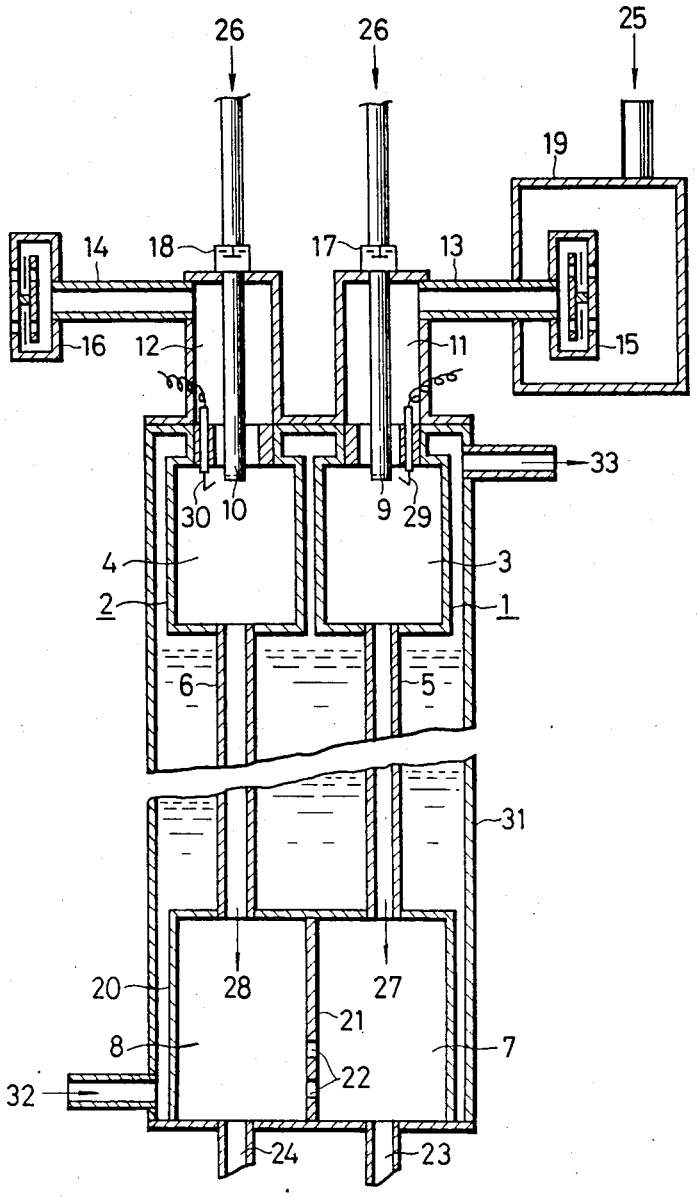
FIG. 3 is a schematic partially cross-sectional front view of an embodiment of the pulse combustion apparatus according to the present invention.
Figure 4A:
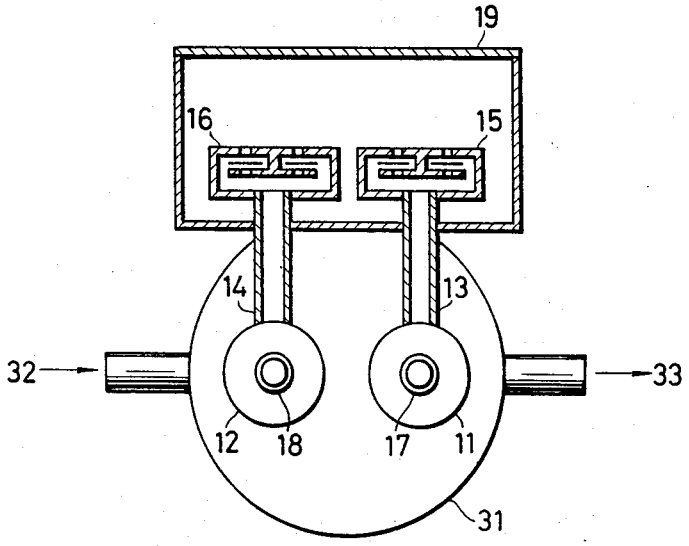
FIG. 4A is a top plan view of the embodiment of FIG. 3, partially showing by way of a cross-section.

Referring now to FIG. 3, a schematic partially cross-sectional front view of an embodiment of the pulse combustion apparatus is shown. The pulse combustion apparatus according to the invention will be described in connection with hot-water supply apparatus using a gas as a fuel. A schematic top plan view of the pulse combustion apparatus is shown in FIG. 4. The embodiment of FIGS. 3 and 4 as well as the following embodiments are all directed to such apparatus using two or more gas burners 1 and 2 which are juxtaposed. These two gas burners 1 and 2 such have combustion capability which is half the total amount of fuel to be consumed. 3 and 4 respectively indicate combustion chambers of the burners 1 and 2. 5 and 6 are tail pipes whose upper ends are respectively coupled with the combustion chambers 3 and 4 at the exhaust gas side of the combustion chambers 3 and 4. 7 and 8 are cushion chambers respectively coupled with the tail pipes 5 and 6.

The cushion chambers 7 and 8 are formed by bisecting a single chamber 20 by a partition 21. The cushion chambers 7 and 8 communicate with each other via one or more communicating passages or through-holes 22 made in the partition 21 at a place close to exhaust outlets thereof to which exhaust pipes 23 and 24 are respectively connected. The references 9 and 10 are distributors of fuel gas, which is led into the combustion chambers 1 and 2 therethrough. 11 and 12 are air chambers communicating with the combustion chambers 1 and 2 respectively at their inlet side. 13 and 14 are air pipes respectively coupled with the air chambers 11 and 12. 15 and 16 are air valves connected to one end each of the air pipes 13 and 14. 17 and 18 are fuel valves.

19 indicates an intake air cushion chamber in which the air valves 15 and 16 are installed as shown in FIG. 4 (FIG. 3 illustrates one air valve 16 as being located outside the intake air cushion chamber 19 for convenience). More specifically, the air pipes 13 and 14 as well as the air valves 15 and 16 are arranged in parallel as shown in FIG. 4 so as to lead intake air into respective pulse burners 1 and 2. 23 and 24 are exhaust pipes coupled with the cushion chambers 7 and 8 at their exhaust side. Intake air flow is shown by an arrow 25, while fuel gas flows are shown by arrows 26. In addition, exhaust gas flows are shown by arrows 27 and 28. 29 and 30 indicate ignition plugs. 31 is a casing in which water to be heated in contained as shown. 32 is an water inlet, and 33 is a hot water outlet.

The pulse burner of FIG. 3 operates as follows. Fuel gas 26 under supply pressure is fed via the fuel valves 17 and 18 to the distributers 9 and 10 from which the fuel gas is sprayed into the combustion chambers 3 and 4. Air to be used for combustion is fed under pressured by way of a blower (not shown) as an airflow 25 to be led into the intake air cushion chamber 19. Then the air in the intake air cushion chamber 19 is fed via the air valves 15 and 16, air pipes 13 and 14, and air chambers 11 and 12 to the combustion chambers 3 and 4. The fuel gas and air respectively reaching the combustion chambers 3 and 4 become a mixture in each thereof, to be ignited and exploded with the operation of the ignition plugs 29 and 30. As a result of such an explosion, pressure in the combustion chambers 3 and 4 suddenly increases causing the air valves 15 and 16 and the fuel valves 17 and 18 to be closed. Therefore, fuel gas supply and air supply are both interrupted. Then high temperature combustion gas in the combustion chambers 3 and 4 flows via the tail pipes 5 and 6, heating the water within the casing 31, into the cushion chambers 7 and 8 as indicated by the exhaust gas flows 27 and 28.

The exhaust gas in the cushion chambers 7 and 8 is then exhausted outside the apparatus via the exhaust pipes 23 and 24 and an exhaust silencer (not shown). As the exhaust gas flows out, the pressure within the combustion chambers 3 and 4 assumes a negative value. With such a negative pressure, the air valves 15 and 16 and the fuel valves 17 and 18 open to intake air and fuel gas, which are mixed to be a mixture in each of the combustion chambers 3 and 4, for subsequent combustion. On the other hand, the speed of the flow of the combustion gas, which has continuously been flowing out, now reduces due to the negative pressure within the combustion chambers 3 and 4, and the combustion gas emitted outside the combustion chambers 3 and 4 now partially flows back thereinto. As a result of such reflux of high temperature combustion gas, the mixtures newly introduced into the combustion chambers 3 and 4 are ignited and exploded since the high temperature combustion gas flowed back functions as an ignitor. Although there are other theories for explaining the automatic reignition, the reason of the automatic reignition has nothing to do with the essence of the present invention. Such automatic reigniting process is repeatedly carried out to establish a pulse combustion state. When such pulse combustion state is made stable, it automatically continues even if the unshown blower for producing the intake airflow 25 and the ignition plugs 29 and 30 are disabled.

Although the pulse burners 1 and 2 are manufactured to have identical structure and size, there are slight differences in size due to scattering in size of parts and in assembling errors. Because of such difference, there arises a time difference in combustion timing and therefore, the frequencies of the combustion between the two pulse burners 1 and 2 are not equal to each other. Therefore, when these two burners 1 and 2 operate simultaneously in a parallel arrangement, beat occurs between combustion sounds from both the pulse burners 1 and 2. This beat is uncomfortable and provides a new source of noise against the object of noise reduction. The present invention has suppressed such noise with the following arangements.

As described in the above, the two cushion chambers 7 and 8 communicate with each other via communicating passage 22 made in the partition 21. With the provision of such a communicating passage 22, the pressure variation in the cushion chamber 7 interacts or interferes with the pressure variation in the other cushion chamber 8. Therefore, the pressure variation in respective cushion chambers 7 and 8 affects the intake and exhaust processes in associated combustion chambers 3 and 4 so that these processes are synchronized with each other. Accordingly, the two burners 1 and 2 carry out combustion at an identical interval or period so as to burn fuel gas simultaneously without generating uncomfortable beat. Since generation of the beat is effectively suppressed in the present invention, a noise reduction by using a plurality of pulse burners can be achieved.

Turning back to FIG. 2, a solid curve indicates measured values of noise reduction with respect to the number of burners when a total amount of fuel is divided into two to four. From the comparison between the solid curve showing the actually measured values and the dotted curve showing theoretically obtained values, it is to be understood that noise reduction can be obtained such that the amount of noise reduction is greater than the theoretically calculated values by approximately 3 dB. The reason that the actually measured noise level is lower than calculated noise level is deemed to be caused by the interaction or interference between the combustion sounds from the plurality of pulse burners, and the fact that the mechanical strength of the entire burner assembly including a plurality of burners is much greater than that of a single burner. As will be understood from the solid curve of FIG. 2, when the total amount of fuel is divided into two so that two pulse burners are used, noise reduction of 6 to 6.5 dB can be obtained at the sound source. If the numer of divisions is increased to be more than three, noise reduction effect gained by the increase of burners is relatively small because the curve of noise reduction beyond three burners is not sharp. Therefore, the number of pulse burners to be used in combination is usually set to either two or three. However, when it is intended to burn a large amount of fuel, the number of pulse burners may be increased beyond three, for instance to four as will be seen some embodiments of the present invention, so that each burner covers a lesser amount of fuel combustion.

The cross-sectional area of the communicating passage 22 has to be carefully selected. When the cross-sectional area is too small, the above-mentioned synchronism between combustions in the combustion chambers 3 and 4 does not occur, and thus beat occurs in the same manner as in the case of no such communicating passage. According to experiments, in order to obtain satisfactory interaction, the cross-section of the communicating passage 22 is preferably selected to be over 1/20 of the cross-section of each of the tail pipes 5 and 6. Furthermore, in order to prevent the communicating passage 22 from being closed by condensed water from the exhaust gases, the diameter of the communicating passage 22 is preferrably larger than 3 millimeters. On the contrary, when the cross-section of the communicating passage 22 is too large, interaction in the pressure variation between the cushion chambers 7 and 8 is excessive, and ignition characteristics at the beginning of combustion deteriorate and combustion becomes unstable. In order to obtain a satisfactory interacting or interference function without suffering these problems, the cross-sectional area of the communicating passage 22 is preferably made smaller than 1/10 of the cross-sectional area of each of the tail pipes 5 and 6. Therefore, the cross-sectional area of the communicating passage or through-hole 22 is preferably set to a value between 1/20 and 1/10 of the cross-section of the tail pipe 5 or 6. When a plurality of through-holes 22 are provided, the above size range applies to the total cross-sectional area of the plurality of through-holes.

Figure 4B:
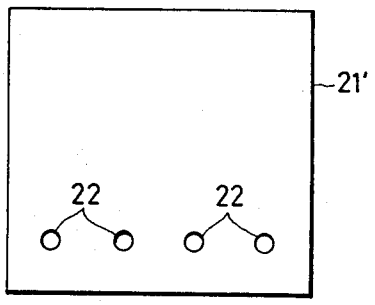
FIG. 4B is a top plan view of the partition used in the embodiment of FIGS. 3 and 4A.

An interaction or interference device including the above-mentioned communicating passage or through-hole 22 made in the partition 21 may be formed in various ways. In the embodiment illustrated in FIG. 3, two of such communicating passages or through-holes 22 are shown, and the number of the communicating passages or through-holes 22 may be increased if desired. FIG. 4B shows a top plan view of a partition 21' which may be used in place of the partition 22 of FIG. 3. In this partition 21', four through-holes 22 are arranged horizontally, and each throuh-hole 22 is a substantially circular opening. The shape of the through-holes 22 may be changed, if desired, to other shapes such as an oval.

Figure 5:
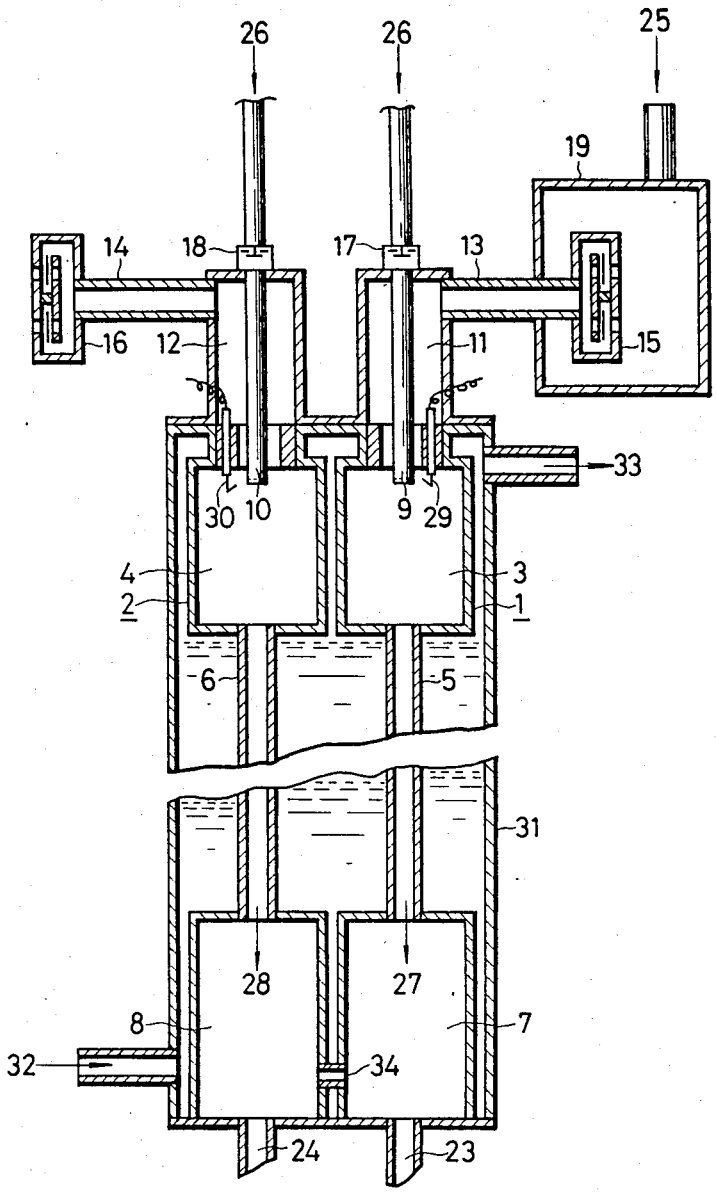
FIG. 5 is a schematic partially cross-sectional front view of another embodiment of the pulse combustion apparatus according to the present invention, wherein cushion chambers are individually provided.

FIG. 5 shows another embodiment in which the cushion chambers 7 and 8 of the first and second pulse burners 1 and 2 are respectively separately formed from each other where these two cushion chambers 7 and 8 communicate with each other via a communicating tube 34. The remaining structure of the embodiment of FIG. 5 is the same as that of FIGS. 3 and 4, and this embodiment operates in the same manner as the previous embodiment. In order to obtain satisfactory interaction, the cross-sectional area of the communicating tube 34 is preferrably set to a value which is greater than 1/20 and smaller than $\frac{1}{3}$ of the cross-section of each of the tail pipes 5 and 6.

Figure 6:
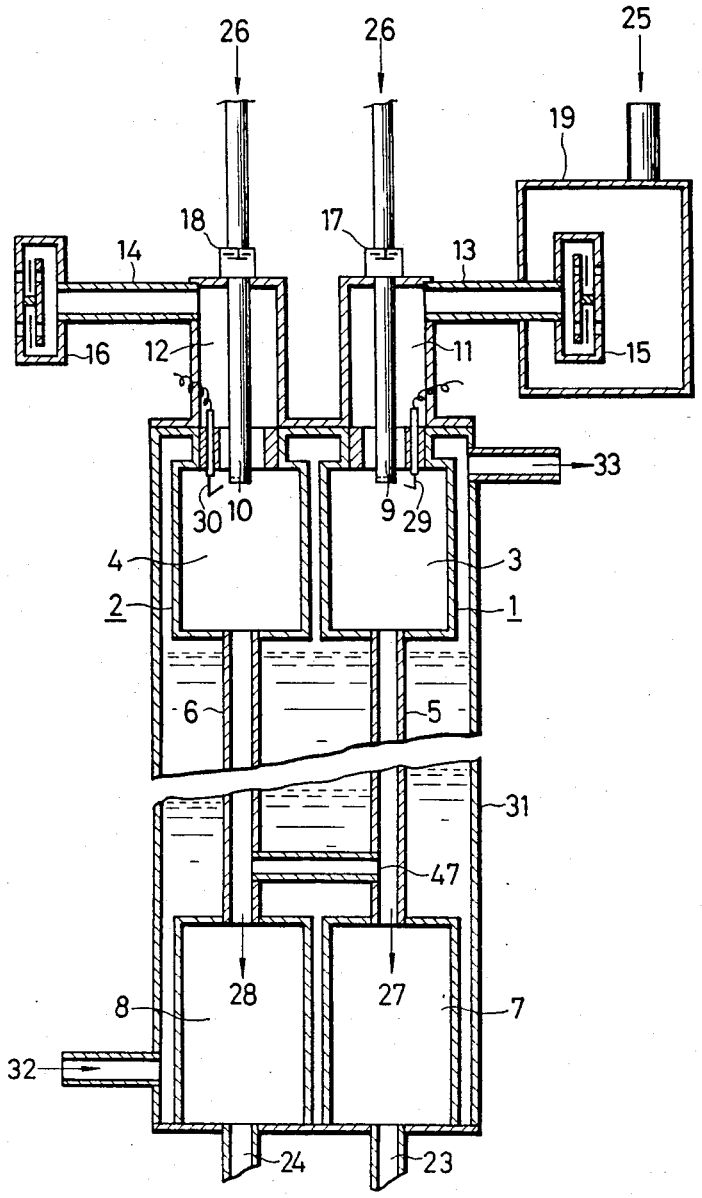
FIG. 6 is a schematic partially cross-sectional front view of another embodiment of the pulse combination apparatus according to the present invention, wherein a communicating passage is provided between tail pipes.

FIG. 6 shows another embodiment, which differs from the embodiment of FIG. 5 in that the two tail pipes 5 and 6 are arranged to communicate with each other via a communicating passage 47 provided therefor, instead of the communicating tube 34 of FIG. 5. In this case, in order to obtain satisfactory interaction, the cross-sectional area of the communicating tube 47 is preferably set to a value which is greater than 1/20 and smaller than $\frac{1}{3}$ of the cross-section of each of the tail pipes 5 and 6.

Figure 7:
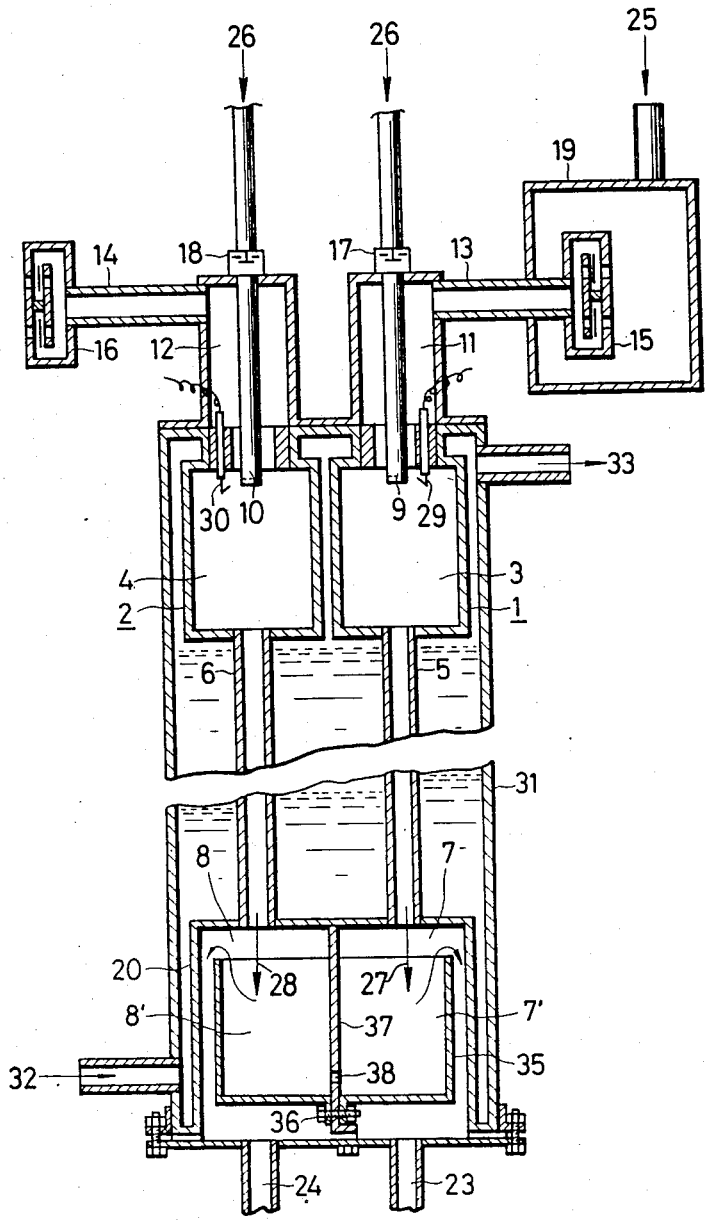
FIGS. 7 and 8 are schematic partially cross-sectional front views of another embodiments of the pulse combustion apparatus according to the present invention, wherein sound-shielding cylinders are provided within the cushion chambers, FIGS. 7 and 8 respectively corresponding to FIGS. 3 and 5.

To provide a quiet pulse combustion apparatus it is useful to attenuate the explosion or combustion sound occurred in the combustion chambers as it is propagating toward upstream and downstream portions in addition to reducing the noise level of the sound source. FIG. 7 shows an embodiment having a sound insulating device which attenuates the sound level propagating downstream. Within two cushion chambers 7 and 8, made by dividing a single chamber 20 by a partition 37, a bottom cylindrical casing 35 functioning as a sound-shielding member is attached to the partition 37 by way of bolts and nuts 36. With the provision of the bottom cylindrical member 35 two buffer chambers 7' and 8' are formed whch communicate with each other through a communicating passage or through-hole 38 made in the partition 37. The remaining structure is the same as that of the embodiment shown in FIGS. 3 and 4.

The embodiment of FIG. 7 operates as follows. Exhaust gas flows 27 and 28 from the tail pipes 5 and 6 as well as combustion noise collide against the bottom of the bottomed cylindrical memer 35 in the presence of the same, and return to upstream portions so as to flow downstream via a gap or space defined by the outer surfaces of the bottom cylindrical member 35 and the inner surfaces of the cushion chambers 7 and 8. As a result, the exhaust gases flow into the exhaust pipes 23 and 24. With such flow of the exhaust gases therefore, the combustion sound is attenuated before the exhaust gases enter into the the exhaust pipes 23 and 24 when compared to the case where exhaust gases and combustion sound directly flow into the exhaust pipes 23 and 24 although there is a difference in speed between sound and gas flow. As a result, noise level is decreased while the heat exchange coefficient is improved since the exhaust gases flow as a high speed flow in the gap to be in contact with the inner surfaces of the cushion chambers 7 and 8.

Figure 8:
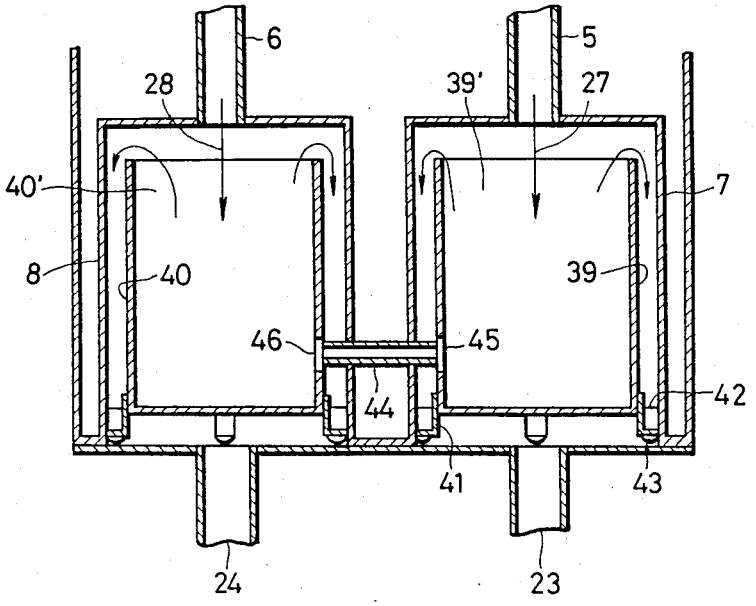

Referring now to FIG. 8, another embodiment of the present invention is shown by a partial cross-sectional view. This embodiment is a modification of the embodiment of FIG. 5. More specifically, bottom cylindrical members 39 and 40 are respectively provided within two separate cushion chambers 7 and 8 of the two burners for forming two buffer chambers 39' and 40'. The bottom cylinders 39 and 40 function as sound shielding members and are fixed by metal fittings 41 and 42 and screws 43. A communicating tube 44 protrudes inside both the cushion chambers 7 and 8 so as to face openings 45 and 46 made in walls of the bottom cylindrical members 39 and 40 with each other. Therefore, buffer chambers 39' and 40' are respectively formed. Although, the communicating tube 44 is not in contact with the bottom cylindrical members 39 and 40, if desired, it may be connected and fixed at both ends thereof to the walls defining the openings 45 and 46. The operation of the communicating tube 44 and the bottom cylindrical members 39 and 40, as well as remaining structure and its operation, are the same as those of FIG. 7.

Figure 9:
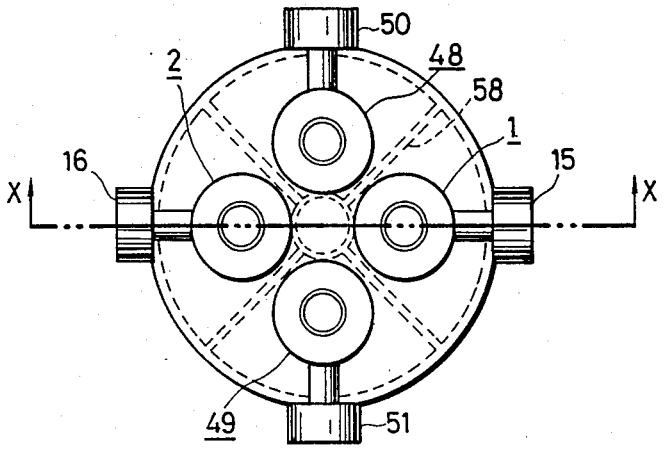
FIG. 9 is a schematic top plan view of another embodiment of the pulse combustion apparatus according to the present invention, wherein two or more pulse burners are juxtaposed with an interaction chamber therebetween.
Figure 10A:
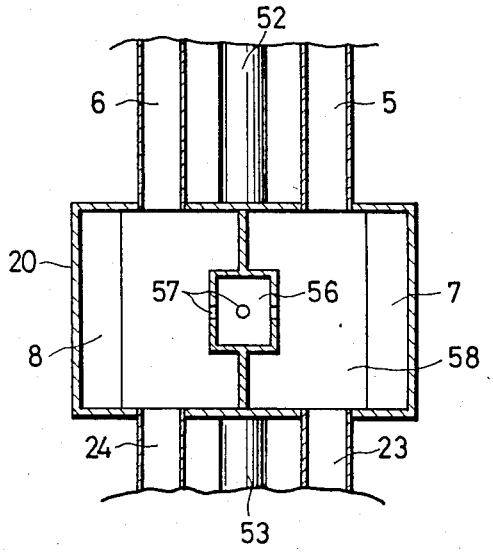
FIG. 10A is a schematic cross-sectional front view of the cushion chambers of the embodiment of FIG. 9 taken along a line X—X.
Figure 10B:
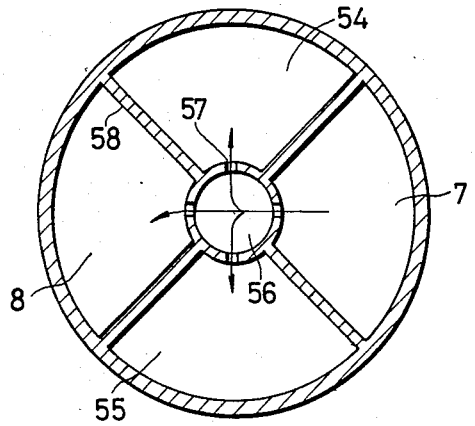
FIG. 10B is a schematic cross-sectional top plan view of the cushion chambers of the embodiment of FIG. 9.

FIGS. 9, 10A and 10B are a top plan view, a partial front cross-sectional view and a cross-sectional top plan view of a further embodiment having four pulse burners juxtaposed within an interaction chamber. As shown in the top plan view of FIG. 9, in addition to first and second burners 1 and 2, third and fourth burners 48 and 49 are provided so that the four burners are arranged in parallel. 50 and 51 are air valves for the burners 48 and 49 while the first and second burners 1 and 2 are respectively equipped with air valves 15 and 16 in the same manner as in previous embodiments.

In FIG. 10A, the reference 52 and 53 are respectively a tail pipe and an exhaust pipe of the third burner 48. A single chamber is divided by partitions 58 into four parts which function as cushion chambers 7, 8, 54 and 55 of the four burners as best seen in FIG. 10B. At the center of these four cushion chambers 7, 8, 54 and 55, an interaction chamber 56 is provided where each cushion chamber communicates therewith via communicating passages or through-holes 57. Although the interaction chamber 56 is provided in this embodiment, the interacting or interference function described with reference to FIG. 3 can also be obtained in this embodiment. The provision of the interaction chamber 56 makes it easy to design a pulse combustion apparatus having two or more pulse burners juxtaposed, and therefore a pulse combustion apparatus with a plurality of pulse burners is readily provided while the two or more pulse burners can operate simultaneously without generating beat.

Figure 11:
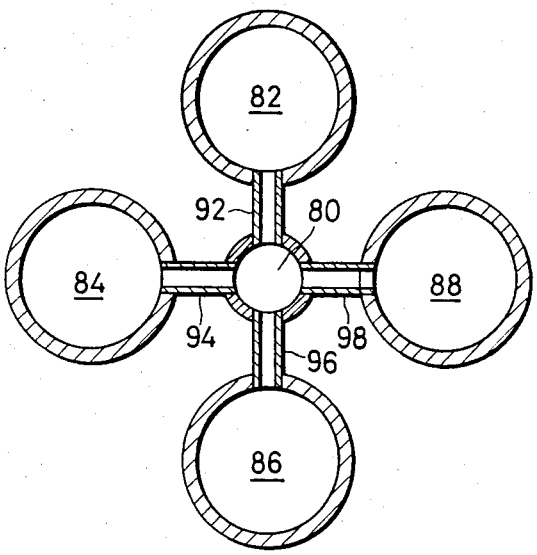
FIG. 11 is a schematic cross-sectional top plan view of cushion chambers of another embodiment which is a modification of the embodiment of FIGS. 9, 10A and 10B.

FIG. 11 shows a modification of the above-described embodiment of FIGS. 9, 10A and 10B. Four cushion chambers 82, 84, 86 and 88 are separately provided around an interaction chamber 80 which is located at the center. The interaction chamber 80 communicates with all the cushion chambers by communicating tubes 92, 94, 96 and 98 radially arranged. This embodiment functions in the same manner as the above embodiment of FIGS. 9, 10A and 10B.

Figure 12:
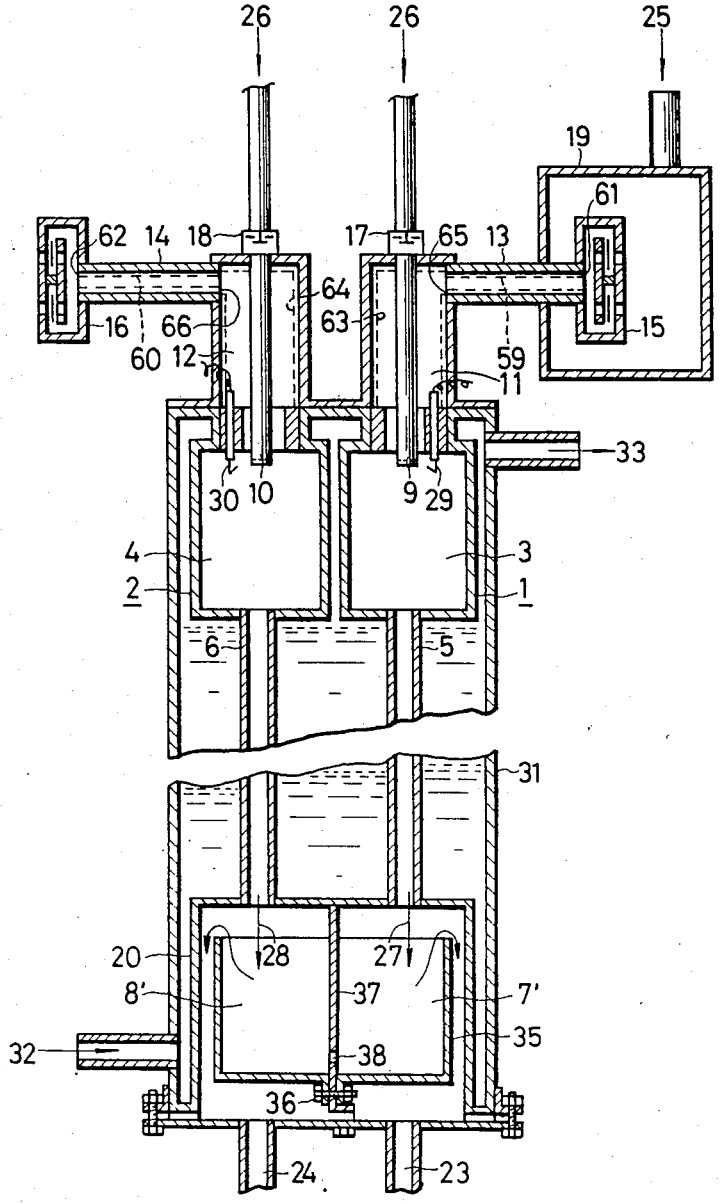
Figure 13:
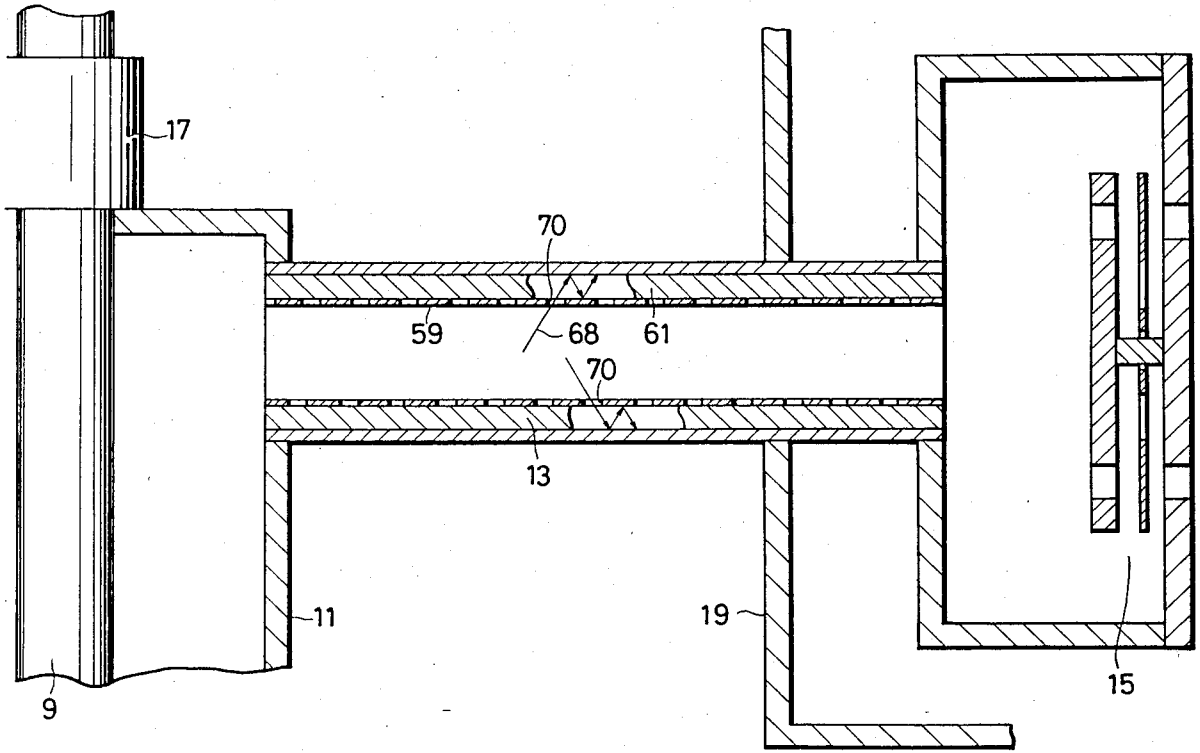
FIG. 13 is a detailed cross-sectional view of an air pipe in the embodiment of FIG. 12.

FIG. 12 shows a further embodiment having a sound absorption mechanism which decreases the combustion sound propagating from the combustion chambers to upsream portions. In this embodiment, cylindrical tubes 59 and 60 made of punched sheet metal having a number of small holes 70 are coaxially arranged respectively inside the air pipes 13 and 14. In addition, each gap or space between the cylindrical tubes 59 and 60 and the air pipes 13 and 14 is filled with sound absorption material 61 and 62 having sufficient resistance to flow in view of fluid dynamics and showing no resistance to airflow within the cylindrical tubes 59 and 60. FIG. 13 is a detailed diagram showing the above-described structure at the air pipe 13.

Figure 14:
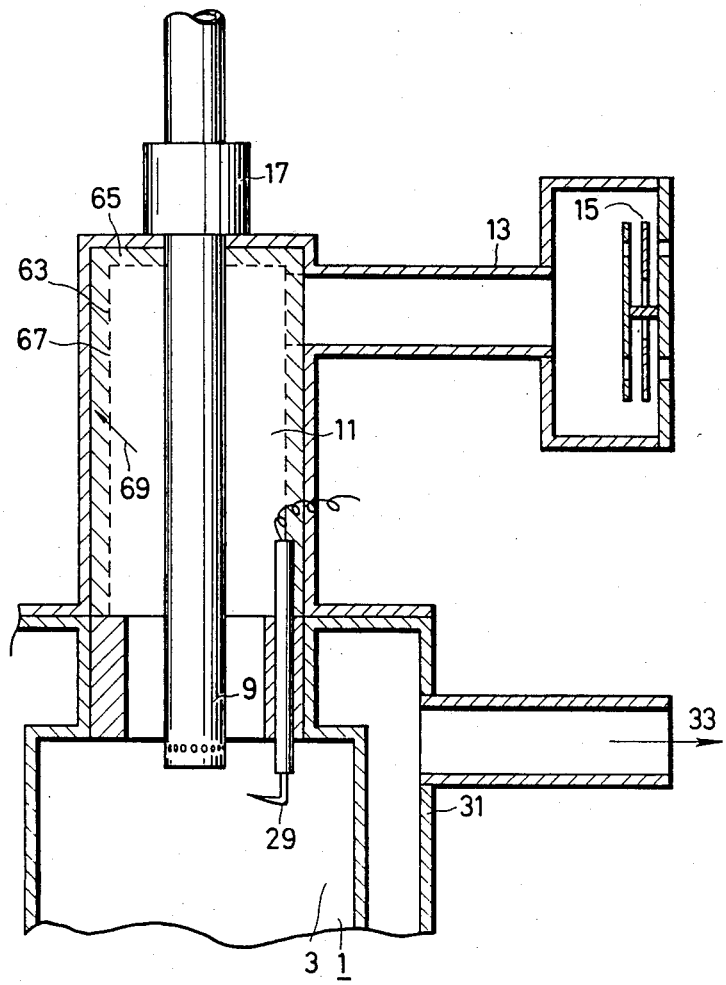
FIG. 14 is a detailed cross-sectional view of an air chamber in the embodiment of FIG. 12.

In addition, punched metal sheets 63 and 64, each having a number of small holes 67, are respectively provided to the inner surfaces of the air chambers 11 and 12 with a given gap or space from the inner surfaces. The gap portions are filled with sound absorption materials 65 and 66 in the same manner as in FIG. 13. FIG. 14 shows the above-described structure within the air chamber 11 in detail. The remaining structure is the same as that shown in FIGS. 3 and 4.

When the pulse combustion apparatus of FIGS. 12 to 14 operates, a portion of sound propagating upstream from the combustion chambers 3 and 4 enters into the gap portions through the small holes 70 and 67 of the punching metal sheets 59, 60, 63 and 64 as indicated by arrows in FIGS. 13 and 14. As a result the sound entered in the gap portions repeatedly reflects between the punched metal sheets 59, 60, 63 and 64 and the walls of the air pipes 13 and 14 or the walls of the air chambers 11 and 12, so that the sound is absorbed by the sound absorption materials 61, 62, 65 and 66 in the gap portions. With this operation, therefore, the combustion sound propagating upstream is attenuated as it goes further from the combustion chambers 3 and 4, contributing to the reduction in overall noise from the pulse combustion apparatus.

As is apparent from the foregoing description, according to the present invention "n" pulse burners, to which a given amount of fuel combustion corresponding to that obtained by dividing a given total amount by "n" is supplied, are juxtaposed such that they communicate with each other at their cushion chambers or tail pipes via communicating passages(s) or tube(s), so that interaction occurs among the "n" pulse burners resulting in the synchronism of combustion timing therebetween. As a result, the occurrence of uncomfortable beat can be effectively suppressed, and thus the noise level of the sound source can be remarkably reduced. Furthermore, in improved or modified embodiments, the combustion sound generated in combustion chambers is effectively attenuated as it propagates upstream and/or downstream by way of sound-shielding members and/or sound absorption members. The provision of the sound-shielding members in the cushion chambers results in increase in heat exchange efficiency.

The above-described embodiments are only examples of the present invention, and therefore, it will be apparent for those skilled in the art that many modifications and variations may be made without departing from the scope of the present invention.

What is claimed is:

1. A pulse combustion apparatus, comprising:

(a) a fuel supply means;

(b) air supply means;

(c) a plurality of pulse burners coupled with said fuel supply means and said air supply means, each of said pulse burners having a combustion chamber, and an exhaust passage including a tail pipe communicating, at one end thereof, with said combustion chamber, and a cushion chamber communicating with said tail pipe at the other end of said tail pipe; and (d) means for establishing communication between said exhaust passages of said plurality of pulse burners, the communication establishing means having a passage whose cross-sectional area is within a predetermined range having an upper limit which is smaller than the cross-sectional area of any tail pipe.

2. A pulse combustion apparatus as claimed in claim 1, wherein said passage of said communication establishing means is coupled between said cushion chambers of said plurality of pulse burners.

3. A pulse combination apparatus as claimed in claim 2, wherein said cushion chambers are defined by a single casing and one or more partitions installed in said casing so as to divide said casing into a plurality of said cushion chambers, and wherein said passage of said communication establishing means comprises at least one through-hole made in said partition.

4. A pulse combination apparatus as claimed in claim 3, wherein the diameter of said through-hole is equal to or greater than 3 millimeters.

5. A pulse combustion apparatus as claimed in claim 3, wherein the cross-sectional area of said through-hole is greater than 1/20 and smaller than 1/10 of the cross-sectional area of each of said tail pipes.

6. A pulse combustion apparatus as claimed in claim 3, wherein said passage of said communication establishing means comprises a plurality of circular openings.

7. A pulse combustion apparatus as claimed in claim 2, wherein said cushion chambers are defined by a plurality of separate casings, and wherein said passage of said communication establishing means comprises at least one communicating tube coupled between said cushion chambers of said plurality of pulse burners.

8. A pulse combustion apparatus as claimed in claim 7, wherein the inner diameter of said communicating tube is equal to or greater than 3 millimeters.

9. A pulse combustion apparatus as claimed in claim 7, wherein the cross-sectional area of said communicating tube is greater than 1/20 and smaller than $\frac{1}{3}$ of the cross-sectional area of each of said tail pipes.

10. A pulse combustion apparatus as claimed in claim 1, further comprising a buffer chamber in each of said cushion chambers, said buffer chamber having an opening facing said other end of said tail pipe, walls defining said buffer chamber being spaced apart from walls of said cushion chamber so that exhaust gases led into said buffer chamber from said tail pipe flow via a passage defined between outer surfaces of said walls of said buffer chamber and inner surfaces of said walls of said cushion chamber toward an outlet.

11. A pulse combustion apparatus as claimed in claim 10, wherein said buffer chambers of said plurality of said pulse burners are defined by a single casing and one or more partitions are installed in said casing so as to divide said casing into a plurality of said buffer chambers, and wherein said passage of said communication establishing means comprises at least one through-hole made in said partition.

12. A pulse combustion apparatus as claimed in claim 11, wherein the diameter of said through-hole is equal to or greater than 3 millimeters.

13. A pulse combustion apparatus as claimed in claim 11, wherein the cross-sectional area of said through-hole is greater than 1/20 and smaller than 1/10 of the cross-sectional area of each of said tail pipes.

14. A pulse combustion apparatus as claimed in claim 10, wherein said buffer chambers of said plurality of pulse burners are defined by a plurality of separate casings, and wherein said passage of said communication establishing means comprises at least one communicating tube coupled between said buffer chambers.

15. A pulse combustion apparatus as claimed in claim 14, wherein the inner diameter of said communicating tube is equal to or greater than 3 millimeters.

16. A pulse combustion apparatus as claimed in claim 14, wherein the cross-sectional area of said communicating tube is greater than 1/20 and smaller than $\frac{1}{3}$ of the cross-sectional area of each of said tail pipes.

17. A pulse combustion apparatus as claimed in claim 2, wherein said cushion chambers are defined by a single casing and one or more partitions installed in said casing so as to divide said casing into a plurality of said cushion chambers, and wherein said passage of said communication establishing means comprises an interaction chamber located at the center of said cushion chambers, said interaction chamber communicating with all of said cushion chambers via through-holes made in a peripheral wall of said interaction chamber.

18. A pulse combustion apparatus as claimed in claim 2, wherein said cushion chambers are defined by a plurality of separate casings, and wherein said passage of said communication establishing means comprises an interaction chamber communicating with all of said cushion chambers via communicating tubes respectively coupled between said cushion chambers and said interaction chamger which is located at the center of said cushion chambers.

19. A pulse combustion apparatus as claimed in claim 1, further comprising sound absorption materials on inner surfaces of air pipes of said air supply means and on inner surfaces of air chambers in which a fuel passage of said fuel supply means is provided.

20. A pulse combustion apparatus as claimed in claim 19, further comprising punching metal sheets provided to the inner surfaces of said air pipes and said air chambers so that said sound absorption materials are filled in spaces between said inner surfaces and said punching metal sheets.

21. A pulse combustion apparatus as claimed in claim 1, further comprising a casing for containing said combustion chambers, said tail pipes and said cushion chambers, said casing being arranged so that heat exchanging fluid is flowable within said casing to be heated by said plurality of pulse burners.

22. A pulse combustion apparatus as claimed in claim 1, wherein said passage of said communication establishing means comprises at least one communicating tube coupled between said tail pipes of said plurality of pulse burners.

23. A pulse combustion apparatus as claimed in claim 22, wherein the inner diameter of said communicating tube is equal to or greater than 3 millimeters.

24. A pulse combustion apparatus as claimed in claim 22, wherein the cross-sectional area of said communicating tube is greater than 1/20 and smaller than $\frac{1}{3}$ of the cross-sectional area of each of said tail pipes.

* * * * *